US006892648B2

(12) United States Patent
Theurer et al.

(10) Patent No.: US 6,892,648 B2
(45) Date of Patent: May 17, 2005

(54) BULK MATERIAL STORAGE CAR WITH SENSOR

(75) Inventors: Josef Theurer, Vienna (AT); Herbert Wörgötter, Gallneukirchen (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/622,292

(22) Filed: Jul. 18, 2003

(65) Prior Publication Data

US 2004/0018073 A1 Jan. 29, 2004

(30) Foreign Application Priority Data

Jul. 23, 2002 (AT) ..... 495/2002 U

(51) Int. Cl.[7] ..... E01B 29/02
(52) U.S. Cl. ..... 104/5
(58) Field of Search ..... 104/2, 3, 5, 8; 105/238.1, 247, 355, 396, 404

(56) References Cited

U.S. PATENT DOCUMENTS 5,201,127 A * 4/1993 Whitaker, Jr. ..... 37/107
5,400,718 A * 3/1995 Theurer et al. ..... 105/239

FOREIGN PATENT DOCUMENTS

EP 0 429 713 B1 * 9/1992 ..... E01B/27/04

* cited by examiner

*Primary Examiner*—S. Joseph Morano
*Assistant Examiner*—Robert J. McCarry, Jr.
(74) *Attorney, Agent, or Firm*—Collard & Roe, P.C.

(57) ABSTRACT

In a freight train comprising at least two like storage cars for bulk material, the storage cars comprising loading containers extending in a longitudinal direction, and the storage cars being supported on undercarriages for movement on a track, each storage car comprises a bottom conveyor band extending in the longitudinal direction for conveying the bulk material in a conveying direction from a rear end to a front end of the loading container, and a transfer conveyor band at the front end of the loading container, the transfer conveyor band being arranged to receive the conveyed bulk material from the bottom conveyor band and projecting from the front end to a preceding one of the two storage cars to transfer the conveyed bulk material to the loading container of the preceding storage car where the transferred bulk material forms a bulk material pile. According to the invention, a sensor device is mounted in the loading container at the rear end thereof for sensing a maximally acceptable height of the bulk material pile.

6 Claims, 1 Drawing Sheet

BULK MATERIAL STORAGE CAR WITH SENSOR

BACKGROUND OF THE INVENTION

1. Field of the Invention

The present invention relates to a freight train comprising at least two like storage cars for bulk material, the storage cars comprising a loading container extending in a longitudinal direction, and the storage cars being supported on undercarriages for movement on a track. The loading container of each storage car comprises a bottom conveyor band extending in the longitudinal direction for conveying the bulk material in a conveying direction from a rear end to a front end of the loading container, a transfer conveyor band at the front end, the transfer conveyor band being arranged to receive the conveyed bulk material from the bottom conveyor band and projecting from the front end to a preceding one of the two storage cars to transfer the conveyed bulk material to the loading container of the preceding storage car where the transferred bulk material forms a bulk material pile, and a sensor device mounted in the loading container for sensing the height of the bulk material pile.

2. Description of the Prior Art

European patent No. 0 429 713 B1 describes a freight train with storage cars of the above-indicated type, wherein a sensor device is mounted at the front end of the loading container, in the conveying direction of the bottom conveyor band. The sensor device may be an optical eye or a mechanical sensor for monitoring the maximally acceptable height of the bulk material pile as the transfer conveyor band fills the loading container with the conveyed bulk material.

SUMMARY OF THE INVENTION

It is the primary object of this invention to simplify the filling operation of the conveyed bulk material into the loading container.

The above and other objects are accomplished by the invention in such a storage car by mounting the sensor device in the loading container of the preceding storage car at the rear end of the loading container for sensing a maximally acceptable height of the bulk material pile.

This enables the loading container of the preceding storage car to be filled automatically exactly to the maximally acceptable height of the bulk material pile and thus to utilize its loading capacity to its fullest. By arranging the sensor device in the loading container at the rear end thereof, it is assured that the bulk material pile, which is conveyed forwardly in the conveying direction of the bottom conveyor band and grows in the longitudinal direction, always has a uniform height. Variations in the amount of conveyed bulk material may be immediately compensated by correspondingly adjusting the conveying speed of the bottom conveyor band so that a uniform filling of the loading container is always obtained. This does not require the attention of an operator.

If the storage car further comprises a device for measuring the conveying path of the bottom conveyor band, the conveying path measuring device being connected to the sensor device, loading will be automatically stopped when the maximally acceptable height of the bulk material pile has been reached.

BRIEF DESCRIPTION OF THE DRAWING

The above and other objects, features and advantages of the present invention will become more apparent from the following detailed description of a now preferred embodiment thereof, taken in conjunction with the accompanying, somewhat schematic drawing wherein.

DETAILED DESCRIPTION OF THE PREFERRED EMBODIMENT

Figure 1:
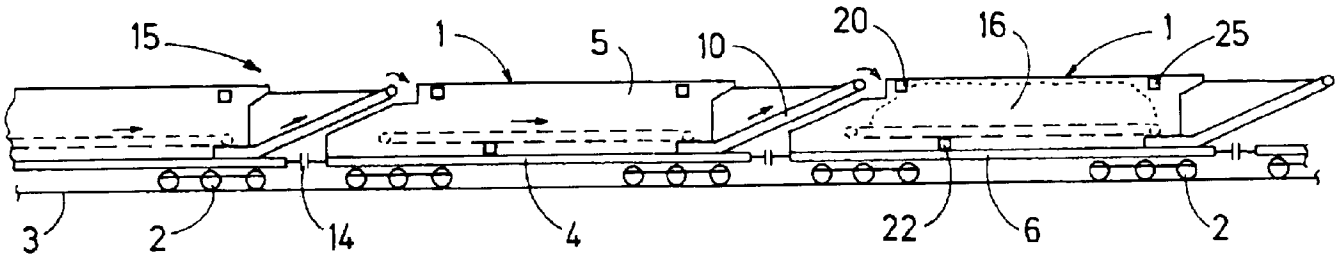
FIG. 1 is a fragmentary side view of a freight train fully showing two like storage cars for bulk material according to this invention.

Referring now to the drawing, there is shown a freight train 15 comprising at least two like storage cars 1 for bulk material 16 to be stored and/or transported. The train may comprise any number of storage cars coupled together by couplings 14. The storage cars comprise loading containers 5 extending in a longitudinal direction and mounted on car frames 4. The car frames are supported on undercarriages 2 for movement on track 3.

Each storage car 1 comprises a bottom conveyor band 6 which extends in the longitudinal direction in loading container 5 for conveying bulk material 16 in a conveying direction indicated by arrow 8 from a rear end 19 to a front end 9 of the loading container. The bottom conveyor band forms the bottom of loading container 5 and is connected to drive 7 for driving the bottom conveyor band in the conveying direction.

A transfer conveyor band 10 is so arranged at front end 9 of loading container 5 that it receives the conveyed bulk material from bottom conveyor band 6, and it projects from front end 9 to loading container 5 of a preceding one of the two storage cars 1 to transfer conveyed bulk material 16 to loading container 5 of the preceding storage car where the transferred bulk material forms bulk material pile 18. As shown, an input end of transfer conveyor band 10 subtends discharge end 11 of bottom conveyor band 6 so that the conveyor bands overlap, and it is mounted on front end 12 of car frame 4. It rises obliquely from car frame front end 12 to its discharge end 17 and is driven by drive 13. In this arrangement, the bottom and transfer conveyor bands 6, 10 of all the storage cars 1 of freight train 15 form a continuous bulk material conveyor, bulk material 16 being transferred in the conveying direction from each discharge end 17 of transfer conveyor band 10 of a succeeding storage car 1 to bottom conveyor band 6 of loading container 5 of a preceding storage car.

Bulk material 16 is simply conveyed in conveying direction 8 through loading containers 5 from storage car to storage car from the back of train 15 to the front of the train at a high conveying speed of conveyor bands 6, 10. However, when drive 7 of bottom conveyor band 6 is actuated to slow its conveying speed, the conveyed bulk material forms pile 18 in loading container 5 and thus stores the bulk material in the loading container.

Figure 2:
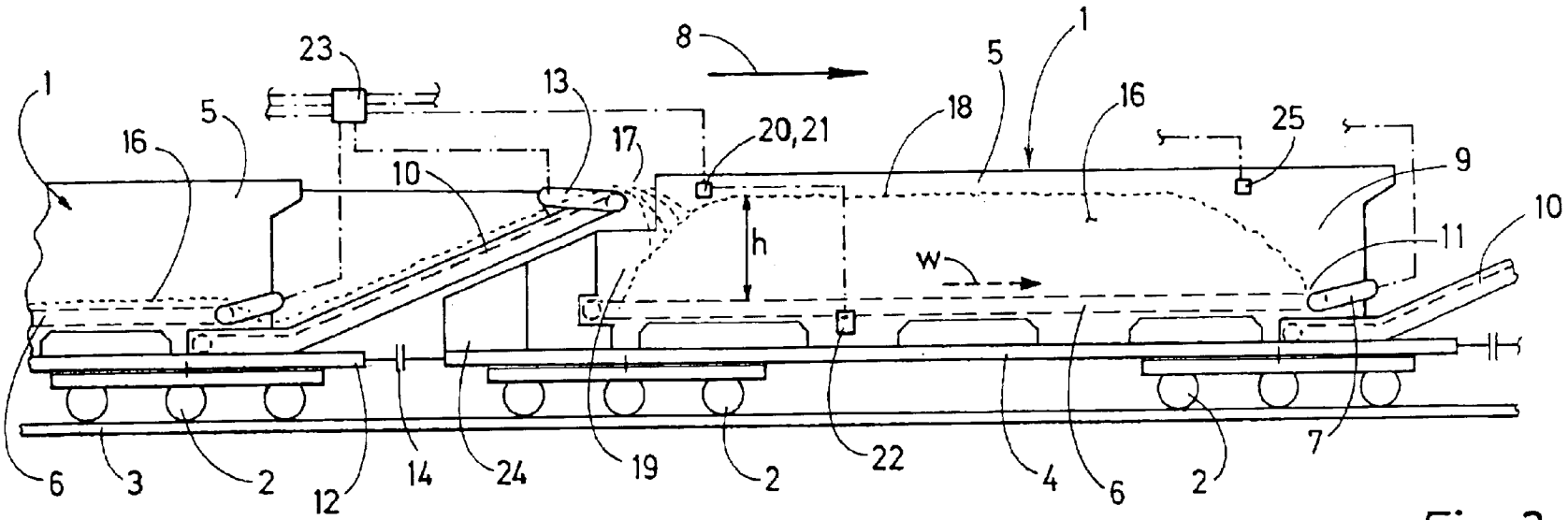
FIG. 2 is an enlarged side view showing the two storage cars in detail.

According to the invention, a sensor device 20 is mounted in loading container 5 of the preceding storage car at its rear end 19 for continuously sensing the filling state so that it may determine a maximally acceptable height h of bulk material pile 18. In the preferred embodiment, the sensor device is a contactless laser distance measuring device 21 which continuously senses bulk material pile 18. However, the sensor device may take any desired form, such as an optical eye or a mechanically operated sensor. In this embodiment, loading container 5 further comprises a device 22 for measuring conveying path of the bottom conveyor band, which is indicated in FIG. 2 by arrow w shown in broken lines. The conveying path measuring device 22 is connected to sensor device 20, 21 in a circuit comprising central control 23 for automatically actuating drives 7, 13 for the bottom and transfer conveyor bands, power being delivered to the actuating drives from power source 24.

Control 23 is arranged for automatically actuating drives 7, 13 for stopping or at least slowing the speed of the drives of bottom and transfer conveyor bands 6, 10 of storage car 1 succeeding the preceding storage car in reponse to a pre-set maximally acceptable height h of bulk material pile 18 sensed by sensor device 20, 21 in the preceding storage car.

In addition to conveying path measuring device 22 or instead thereof, foremost or first storage car 1 of train 15 preferably further comprises another sensor device 25 mounted at front end 9 of its loading container 5 for sensing the height of the bulk material pile 18 in the loading container of this storage car. Sensor device 25 is also connected to control 23 so that bottom conveyor band 6 in this storage car may be automatically stopped, the sensor device 25 being preferably set so that there is sufficient storage space in loading container 5 to provide room for the residual bulk material remaining on the bottom conveyor bands in the succeeding storage cars.

The illustrated freight train described hereinabove is operated in the following manner:

When bulk material 16 is to be stored in loading container 5 of the foremost or first storage car 1 of freight train 15 (see FIG. 2), actuating drive 7 of bottom conveyor band 6 in this loading container is stopped or slowed to a very slow speed while the conveying speeds of bottom conveyor band 6 and transfer conveyor band 10 on succeeding storage car 1 are increased. This causes a bulk material pile 18 to accumulate at rear end 19 of loading container 5 in the preceding storage car. Sensor device 20 at this rear end monitors height h of this accumulating bulk material pile. When an acceptable maximal height of the bulk material pile has been reached, sensor device 20 will transmit a control signal to control 23 which controls the conveying speed of bottom conveyor band 6 in the loading container of the foremost storage car so that bulk material will be moved forwardly sufficiently to reduce height h of bulk material pile 18 sensed at the rear by sensor device 20 and to allow a new bulk material pile to be formed at rear end 19.

At the same time, device 22 continuously measures conveying path w of bottom conveyor band 6 in the loading container of the foremost storage car to ascertain when the first-formed bulk material pile has reached front end 9 of loading container 5 and the loading container has thus been filled to its maximal height. Allowance being made to leave enough storage room in loading container 5 of preceding storage car 1 for receiving the bulk material accumulated at this point on bottom and transfer conveyor bands 6, 10 of the succeeding storage car, bottom conveyor band 6 in loading container 5 of the preceding storage car is automatically stopped.

The loading container of the succeeding storage car now being empty, this operation is repeated step-by-step in each succeeding storage car until all the loading containers are filled, drives 7, 13 for the bottom and transfer conveyor bands 6, 10 being actuated by central control 23 whose output is connected to the drives while its input receives control signals from sensor device 20 and device 22 for measuring the conveying path of the bottom conveyor bands.

What is claimed is:

1. A freight train comprising at least two like storage cars for bulk material, the storage cars comprising loading containers extending in a longitudinal direction, and the storage cars being supported on undercarriages for movement on a track, each storage car comprising (a) a bottom conveyor band extending in the longitudinal direction for conveying the bulk material in a conveying direction from a rear end to a front end of the loading container, (b) a transfer conveyor band at the front end of the loading container, the transfer conveyor band being arranged to receive the conveyed bulk material from the bottom conveyor band and projecting from the front end to a preceding one of the two storage cars to transfer the conveyed bulk material to the loading container of the preceding storage car where the transferred bulk material forms a bulk material pile, (c) a sensor device mounted in the loading container at the rear end thereof for sensing a maximally acceptable height of the bulk material pile, and (d) a control connected to the sensor device for automatically actuating drives for the bottom and transfer conveyor bands.

2. The freight train of claim 1, wherein the control is arranged for automatically actuating the drives for stopping or at least slowing the speed of the drives of the bottom and transfer conveyor bands of the storage car succeeding the preceding storage car in response to a pre-set maximally acceptable height of the bulk material pile sensed by the sensor device in the preceding storage car.

3. The freight train of claim 1, wherein the storage car further comprises a device for measuring the conveying path of the bottom conveyor band, the conveying path measuring device being connected to the sensor device and to the control.

4. The freight train of claim 3, wherein the control is arranged for automatically actuating the drives for stopping or at least slowing the speed of the drives of the bottom and transfer conveyor bands of the storage car succeeding the preceding storage car in response to a pre-set maximally acceptable height of the bulk material pile sensed by the sensor device in the preceding storage car.

5. The freight train of claim 1, wherein the sensor device is a contactless laser distance measuring device.

6. The freight train of claim 1, wherein a foremost one of the storage cars further comprises another sensor device mounted at the front end of the loading container for sensing the height of the bulk material pile.

* * * * *